US010028049B2

(12) United States Patent
Inoue et al.

(10) Patent No.: US 10,028,049 B2
(45) Date of Patent: Jul. 17, 2018

(54) HEADPHONES

(71) Applicant: SONY CORPORATION, Tokyo (JP)

(72) Inventors: Takeshi Inoue, Tokyo (JP); Tomohiro Ito, Tokyo (JP); Hideto Yamamoto, Kanagawa (JP); Hisahiro Tanaka, Chiba (JP); Hirokazu Nishihara, Saitama (JP); Kenji Yamada, Tokyo (JP); Eiji Kuwahara, Tokyo (JP); Kenichi Harada, Tokyo (JP)

(73) Assignee: Sony Corporation, Tokyo (JP)

( * ) Notice: Subject to any disclaimer, the term of this patent is extended or adjusted under 35 U.S.C. 154(b) by 93 days.

(21) Appl. No.: 15/312,739

(22) PCT Filed: Jun. 17, 2015

(86) PCT No.: PCT/JP2015/003024

§ 371 (c)(1),
(2) Date: Nov. 21, 2016

(87) PCT Pub. No.: WO2016/002150

PCT Pub. Date: Jan. 7, 2016

(65) Prior Publication Data

US 2017/0201820 A1 Jul. 13, 2017

(30) Foreign Application Priority Data

Jul. 2, 2014 (JP) ..... 2014-136489

(51) Int. Cl.
*H04R 25/00* (2006.01)
*H04R 1/10* (2006.01)

(52) U.S. Cl.
CPC ..... *H04R 1/1041* (2013.01); *H04R 1/1066* (2013.01); *H04R 1/1008* (2013.01)

(58) Field of Classification Search
CPC ... H04R 1/1066; H04R 1/1008; H04R 1/1041
(Continued)

(56) References Cited

U.S. PATENT DOCUMENTS

2011/0206216 A1* 8/2011 Brunner ..... H04R 1/1066 381/74

FOREIGN PATENT DOCUMENTS

JP 51-32450 Y2 8/1976
JP 54-10258 Y2 5/1979
(Continued)

OTHER PUBLICATIONS

International Search Report prepared by the Japan Patent Office dated Aug. 26, 2015, for International Application No. PCT/JP2015/003024.

*Primary Examiner* — Sunita Joshi
(74) *Attorney, Agent, or Firm* — Sheridan Ross P.C.

(57) ABSTRACT

Provided are headphones with left and right sliders in linkage with each other. The headphones includes: a head band; a first slider that is provided on one end side of the head band and slides with respect to the head band; a second slider that is provided on the other end side of the head band and slides with respect to the head band; a connecting portion that connects the first slider and the second slider and slides the second slider in linkage with a slide operation of the first slider; and a pair of housings that are provided on the first slide portion and the second slide portion, respectively, and each house a sound output unit.

20 Claims, 16 Drawing Sheets

(58) Field of Classification Search
USPC ..... 381/379
See application file for complete search history.

(56) References Cited

FOREIGN PATENT DOCUMENTS

| | | | |
|---|---|---|---|
| JP | 57-51388 | U | 3/1982 |
| JP | 57-91388 | U | 6/1982 |
| JP | 2012-054780 | | 3/2012 |

* cited by examiner

HEADPHONES

CROSS REFERENCE TO RELATED APPLICATIONS

This application is a national stage application under 35 U.S.C. 371 and claims the benefit of PCT Application No PCT/JP2015/003024 having an international filing date of 17 Jun. 2015, which designated the United States, which PCT application claimed the benefit of Japanese Patent Application No. 2014-136489 filed 2 Jul. 2014, the disclosures of which are incorporated herein by reference in their entirety.

TECHNICAL FIELD

The present technology relates to headphones.

BACKGROUND ART

In the past, a variety of headphones having a slide mechanism in order to conform to a size of a head have been proposed (Patent Literature 1).

CITATION LIST

Patent Literature

Patent Literature 1 JP2012-54780A

SUMMARY OF INVENTION

Technical Problem

In headphones disclosed in Patent Literature 1, adjustment of a length of a slider is complex and consumes time and effort.

The present technology has been made in view of the above circumstances and provides headphones that can be easily regulated by a user.

Solution to Problem

In order to solve the above problem, the present technology provides headphones including: a head band; a first slider that is provided on one end side of the head band and slides with respect to the head band; a second slider that is provided on the other end side of the head band and slides with respect to the head band; a connecting portion that connects the first slider and the second slider and slides the second slider in linkage with a slide operation of the first slider; and a pair of housings that are provided on the first slide portion and the second slide portion, respectively, and each house a sound output unit.

Advantageous Effects of Invention

According to the present technology, it is possible to link and slide e and right sliders.

DESCRIPTION OF EMBODIMENT(S)

Hereinafter, embodiments of the present technology will be described with reference to the drawings. The description will proceed in the following order.

<1. First Embodiment>

[1-1. Configuration of Headphones]

<2. Modified Examples>

1. First Embodiment

[1-1. Configuration of Headphones]

Figure 1:
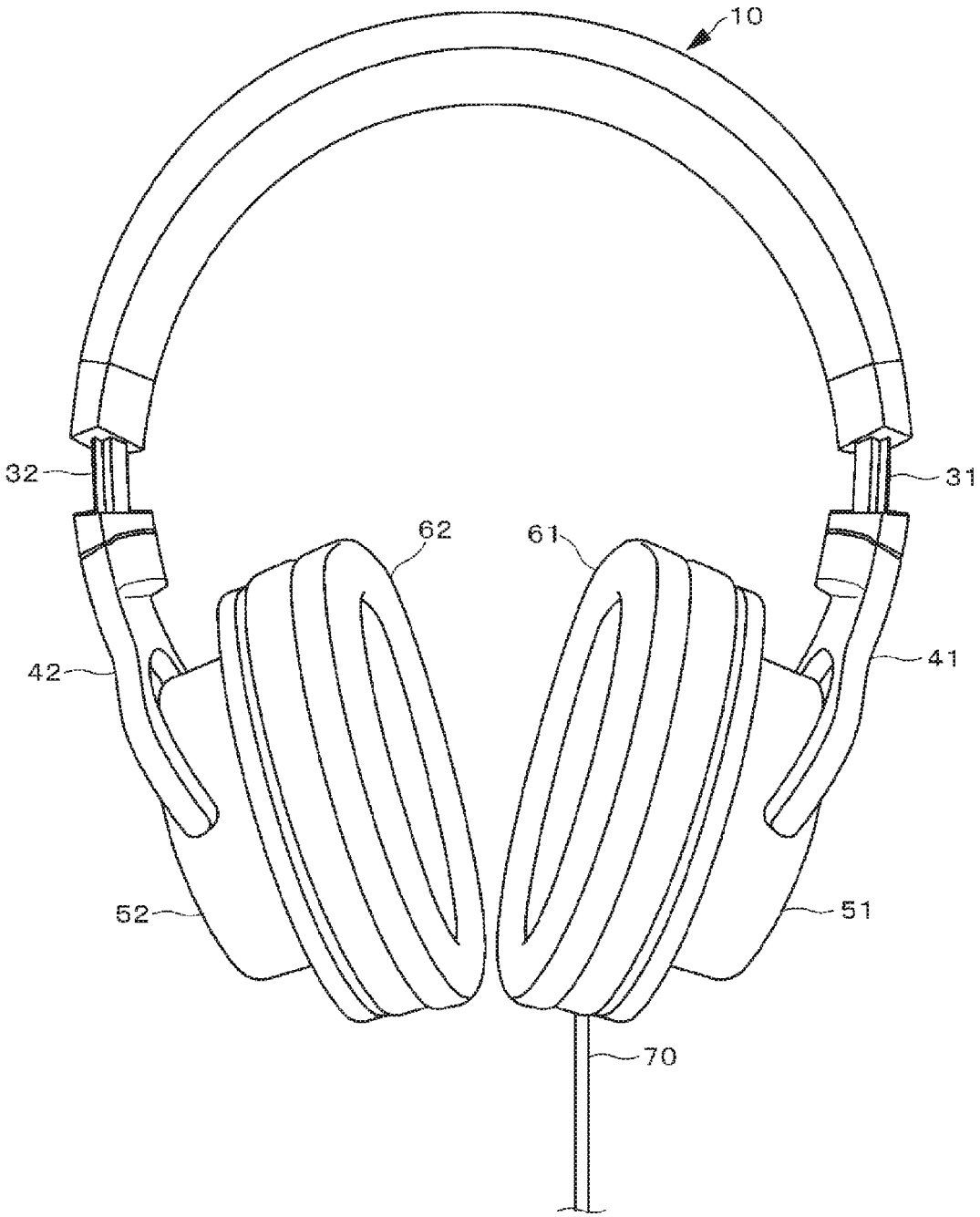
FIG. 1 is a front view illustrating an exterior configuration of headphones according to a first embodiment of the present technology.
Figure 2:
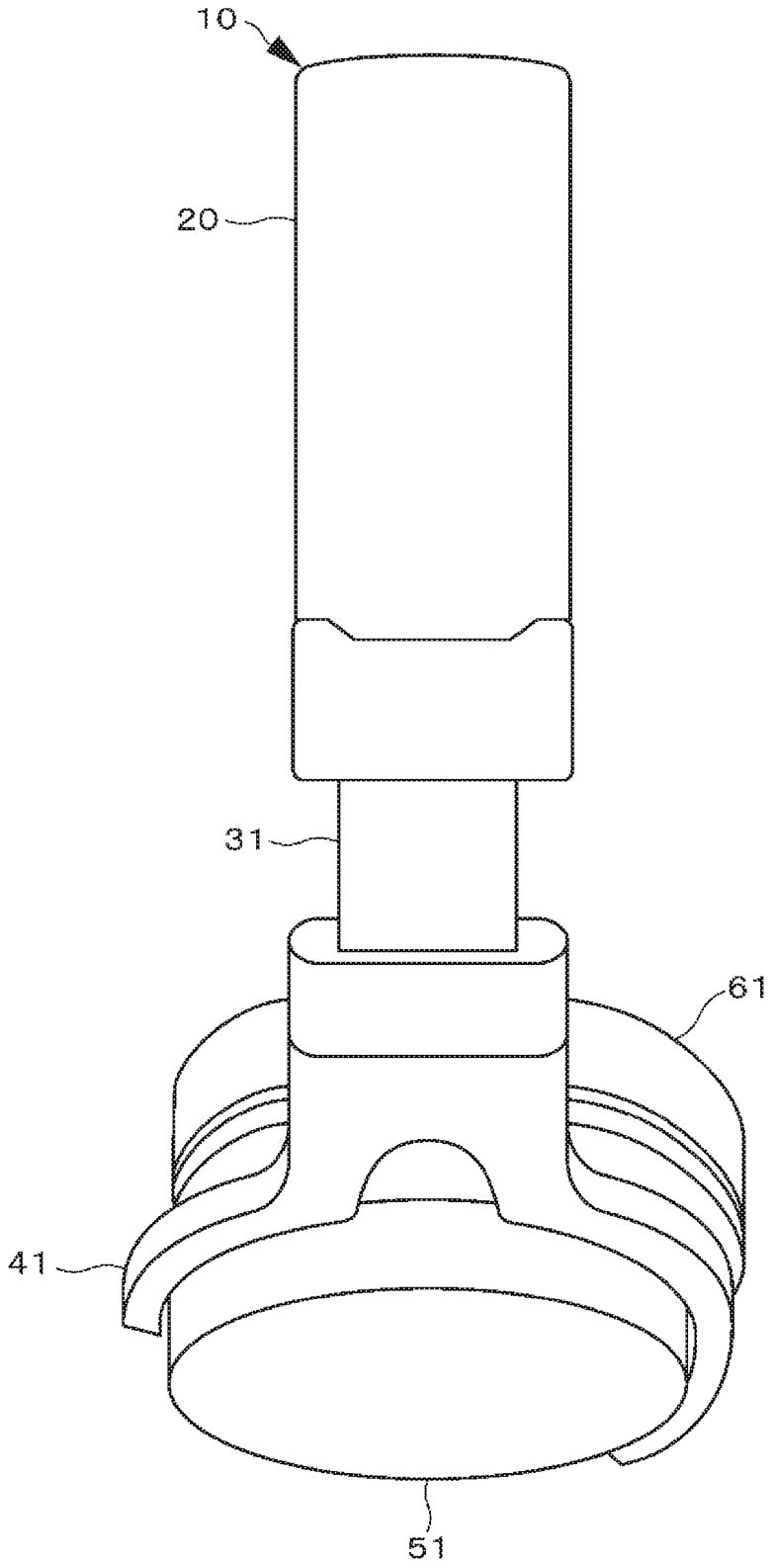
FIG. 2 is a side view illustrating an exterior configuration of headphones.

FIG. 1 is a front view illustrating an exterior configuration of headphones 10. In addition, FIG. 2 is a side view illustrating the exterior configuration of the headphones 10. The headphones 10 include a head band 20, an L-side slider 31, an R-side slider 32, an L-side hanger 41, an R-side hanger 42, an L-side housing 51, an R-side housing 52, an L-side ear pad 61, an R-side ear pad 62, a cord 70 and a linkage slide mechanism.

The head band 20 is formed in a curved shape along a head of a user, comes into contact with a parietal region of a user in a worn state, and thus supports the entire headphones 10. The head band 20 is made of a synthetic resin such as plastic or a metal and has flexibility with a predetermined degree of rigidity and elasticity. Therefore, the housings and the ear pads are pressed in a direction of a temporal region of the user when the headphones 10 are worn, and thus it is possible to maintain a worn state of the headphones 10.

A cover for covering the head band 20 is provided on the head band 20. The cover functions as a cushioning material in a portion abutting the parietal region of the user on an inner surface of the head band 20 and has a role of preventing an internal structure of the head band from being exposed. Alternatively, an elastic body such as a cushion and a rubber may be provided on the portion abutting the parietal region of the user instead of the cover. In addition, a hinge may be provided in the head band 20 so that the head band 20 is folded at its center when carried.

The L-side slider 31 and the R-side slider 32 are provided at both ends of the head band 20. The L-side hanger 41 is provided below the L-side slider 31. In addition, the R-side hanger 42 is provided below the R-side slider 32.

The L-side slider 31 and the R-side slider 32 are provided to be slidable inside the head band 20. When the L-side slider 31 and the R-side slider 32 slide, the L-side hanger 41, the R-side hanger 42, the L-side housing 51, and the R-side housing 52 can be moved downward or upward with respect to the head band 20. When the headphones 10 are worn, a degree of extension of the slider is regulated according to a size of the head of the user and a distance between an ear and a parietal region. Therefore, the L-side ear pad 61 and the R-side ear pad 62 can be adjusted to a position that faces the user's ear. Therefore, the user can obtain a sensation of wearing according to his or her physical features and preferences. On the other hand, when the headphones 10 are not used, the slider is retracted and is in a housed state, and thus it is possible to save storage space.

The L-side slider 31 and the R-side slider 32 have slide positions that may be maintained due to friction with the inner surface of the head band 20 or slide positions that may be maintained by a so-called click mechanism through which positions are maintained by protrusions that are engaged with a plurality of depressions.

The L-side hanger 41 is provided at a distal end of the L-side slider 31 and rotatably supports the L-side housing 51. Similarly, the R-side hanger 42 is provided at a distal end of the R-side slider 32 and rotatably supports the R-side housing 52. The L-side hanger 41 and the R-side hanger 42 rotatably support the L-side housing 51 and the R-side housing 52, respectively, by pivotally supported by support pins (not illustrated) that project inward from the pair of distal ends. Therefore, when the headphones 10 are worn, an orientation thereof is changed according to a shape of the user's ear region, and the L-side housing 51 and the R-side housing 52 can face the ears in a state suitable for the shape of the temporal region of the user.

The L-side housing 51 and the R-side housing 52 function as accommodating portions in which a sound processing circuit, a driver unit, and a speaker (not illustrated) are accommodated. The L-side housing 51 and the R-side housing 52 are made of, for example, a synthetic resin such as plastic. The sound processing circuit performs a predetermined sound signal process, for example, a noise canceling process, a signal amplifying process, and an equalizing process, of a sound signal for driving the speaker. The speaker is a sound output unit configured to output a sound signal on which a process is performed by the sound processing circuit as sound.

The L-side ear pad 61 is provided on a side surface that faces the temporal region of the user in the L-side housing 51. Similarly, the R-side ear pad 62 is provided on a side surface that faces the temporal region of the user in the R-side housing 52. The L-side ear pad 61 and the R-side ear pad 62 are formed to have elasticity, are provided between the housing and the temporal region of the user, and function as cushioning members between the housing and the temporal region of the user. That is, the ear pads prevent the housing made of a hard material that is less easily deformed from being in direct contact with the temporal region of the user when be or she wears the headphones and the user from feeling discomfort or pain.

In addition, the L-side ear pad 61 and the R-side ear pad 62 hermitically enclose spaces that are formed by the ear pads and the temporal region of the user, and have a role of improving sound quality, for example, improving reproducibility of a low frequency range, and also prevent sound output from the speakers from leaking to the outside. Further, the L-side ear pad 61 and the R-side ear pad 62 block noise from the outside and facilitate easy listening to sound from the speakers.

The L-side ear pad 61 and the R-side ear pad 62 include a cushioning portion that is formed in a ring shape and is made of a material having elasticity such as a urethane foam, cotton, or chemical fibers and a cover for covering the cushioning portion. However, the material of the cushioning portion is not limited thereto, and any material having appropriate elasticity may be used.

The cover covers the entire surface of the cushioning portion and is in direct contact with the temporal region of the user when be or she wears the headphones 10. The cover is preferably made of a material having good feeling on skin, for example, a natural leather and a synthetic leather.

The cord 70 has an inside through which an L channel conducting wire and an R channel conducting wire serving as conducting wires for a sound signal and a ground line pass, and transmits a sound signal. The cord 70 is connected to the sound processing circuit that is accommodated inside any one housing between the L-side housing 51 and the R-side housing 52. A conducting wire for a sound signal is supplied to the other housing to which the cord 70 is not connected through a bridge cord that passes through the inside of the head band 20. Alternatively, the two cords 70 may be connected to the L-side housing 51 and the R-side housing 52 such that a sound signal is supplied to the sound processing circuits inside the L-side housing 51 and the R-side.

In addition, a plug (not illustrated) is provided at the other end of the cord 70. When the plug is connected to a sound reproducing device (not illustrated) such as an MP3 player, the headphones 10 are connected to the sound reproducing device. In addition, the plug may be connected to the sound reproducing device through proximity wireless communication such as Wi-Fi or Bluetooth. In this case, a wireless transmitting and receiving unit is provided at a portion that corresponds to one end side of the cord 70. A power supply unit (not illustrated) configured to supply power to an antenna for wireless communication, the sound processing circuit, the driver unit, and the speakers is further accommodated inside the L-side housing 51 and the R-side housing 52.

The headphones 10 may be so-called closed type headphones or may be open air type headphones using ear pads of a urethane foam having air permeability.

Next, a configuration of the linkage slide mechanism will be described with reference to FIG. 3 to FIG. 10. The linkage slide mechanism is a mechanism through which the R-side slider 32 is automatically slid in the same direction in linkage with a slide operation of the L-side slider 31 and at the same time, the L-side slider 31 is automatically slid in the same direction in linkage with a slide operation of the R-side slider 32. The linkage slide mechanism includes an L-side folded portion 111, an R-side folded portion 112, a first wire rod 121, and a second wire rod 122. The first wire rod 121 and the second wire rod 122 correspond to connecting portions in the appended claims.

Figure 3:
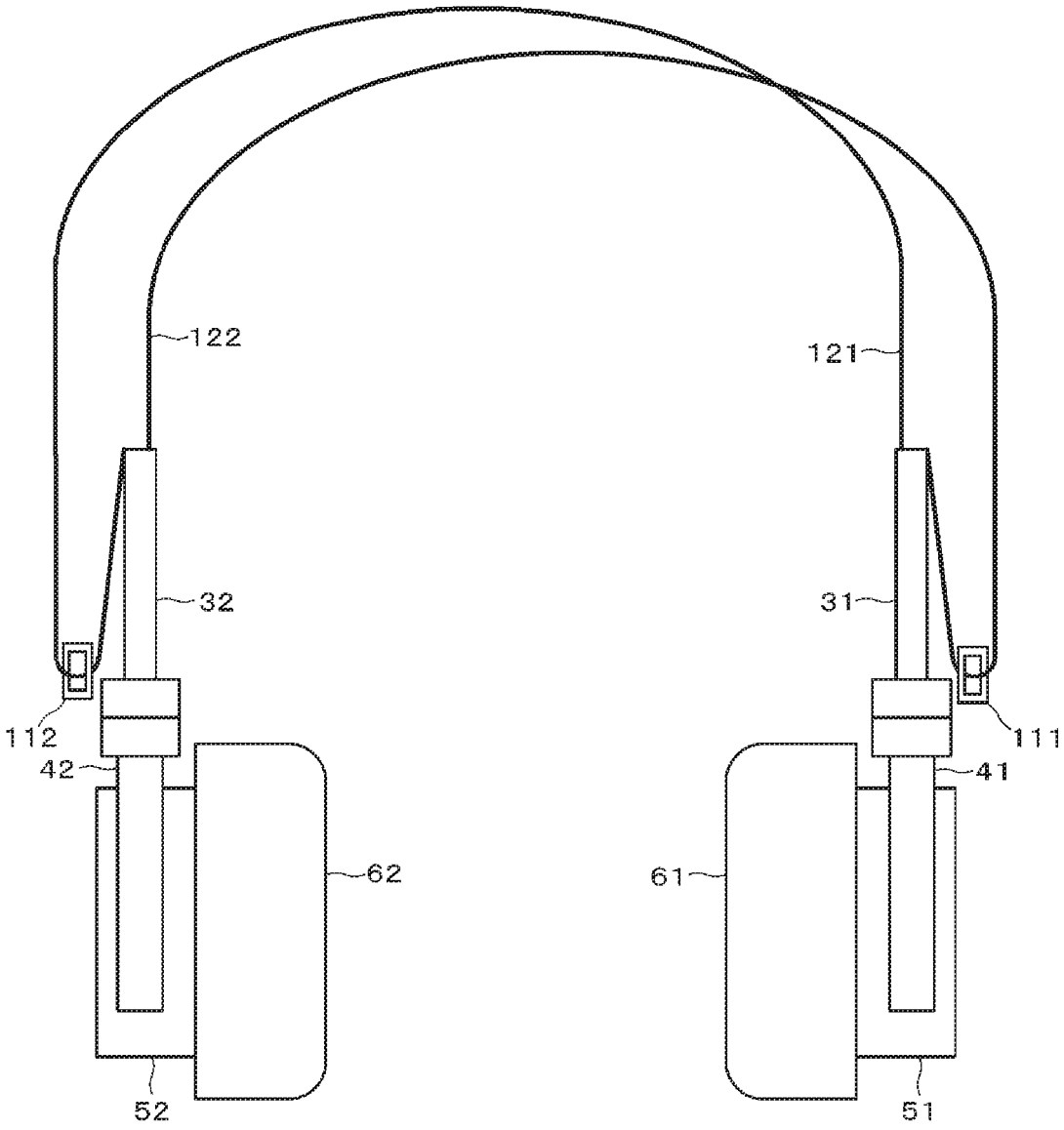
FIG. 3 is a diagram illustrating a connection configuration of wire rods.
Figure 4:
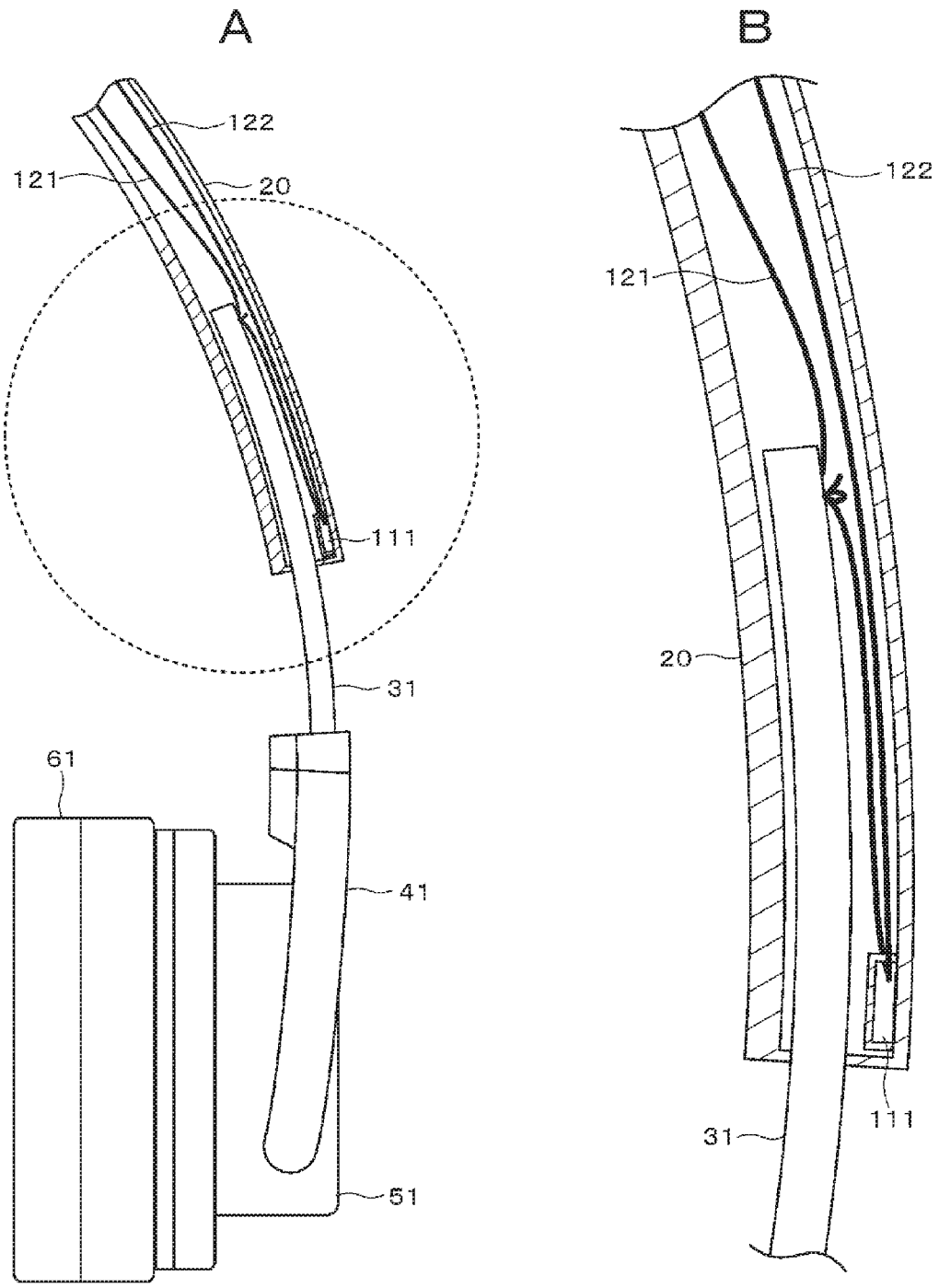
FIG. 4A is a front cross-sectional view illustrating an L-side internal structure of headphones.
FIG. 4B is an enlarged view of a range indicated by the dashed circle in FIG. 4A.

FIG. 3 is a schematic diagram of the headphones 10 and shows a connection mode of the L-side slider 31, the R-side slider 32, the L-side folded portion 111, the R-side folded portion 112, the first wire rod 121, and the second wire rod 122. In FIG. 3, while the head band 20 is not illustrated for convenience of description, the first wire rod 121 and the second wire rod 122 are provided to pass through the head band 20.

As illustrated in FIG. 3, the first wire rod 121 has one end side that is connected to the L-side slider 31, extends to the R-side slider 32 along the head band 20, is folded at the R-side folded portion 112, and is connected to the R-side slider 32. In addition, the second wire rod 122 has one end side that is connected to the R-side slider 32, extends to the L-side slider 31 along the head band 20, is folded at the L-side folded portion 111, and is connected to the L-side slider 31. In this manner, the L-side folded portion 111 and the R-side folded portion 112, and the first wire rod 121 and the second wire rod 122 have configurations that are bilaterally symmetrical.

Figure 5:
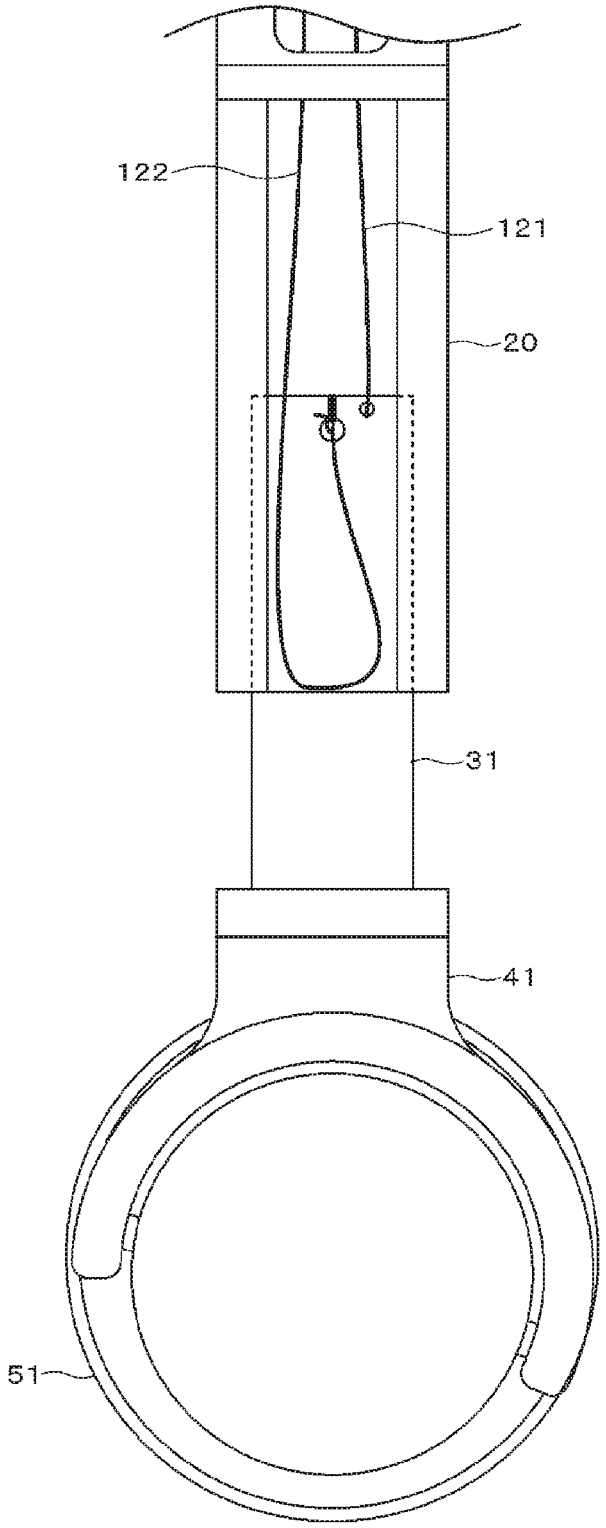
FIG. 5 is a side view illustrating an L-side internal structure of headphones.
Figure 6:
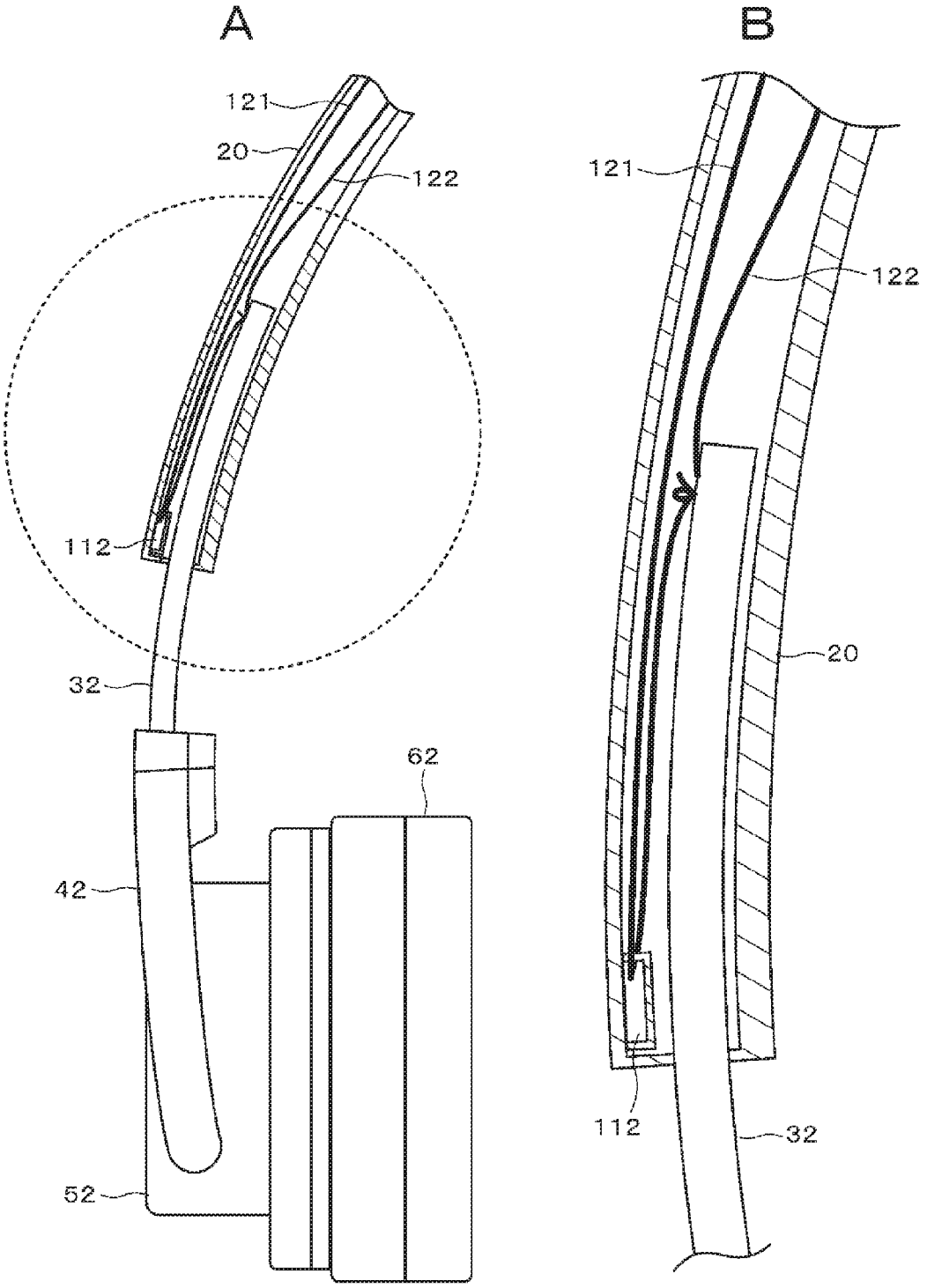
FIG. 6A is a front cross-sectional view illustrating an R-side internal structure of headphones.
FIG. 6B is an enlarged view of a range indicated by the dashed circle in FIG. 6A.

FIG. 4A is a front partial cross-sectional view of an L-side of the headphones 10 and shows a configuration of the L-side folded portion 111, the first wire rod 121, and the second wire rod 122. FIG. 4B is a partially enlarged view when a circle portion indicated by a dashed line in FIG. 4A is enlarged. In addition, FIG. 5 is a side internal view of the headphones 10 and shows a configuration of the L-side folded portion 111, the first wire rod 121, and the second wire rod 122. FIG. 5 is a diagram illustrating the inside of the head band 20 when the cover covering the head band 20 is removed. While the L-side folded portion 111 is not illustrated in FIG. 5, the first wire rod 121 is folded at the L-side folded portion 111.

The L-side folded portion 111 has a shape including an internal hole through which the second wire rod 122 passes and is provided inside the L-side that is one end side of the head band 20.

The second wire rod 122 has the one end side that is connected to the R-side slider 32 and the other end side that is connected to the L-side slider 31. The second wire rod 122 is provided to pass through the inside of the head band 20 and extends downward toward an L-side end of the head band 20. Then, the second wire rod 122 is inserted into the L-side folded portion 111 that is provided at the L-side end of the head band 20 and is folded upward. The folded second wire rod 122 extends upward and is connected to an upper end of the L-side slider 31. A method of connecting the second wire rod 122 and the L-side slider 31 includes a method in which a hole is provided at, for example, the L-side slider 31, the second wire rod 122 passes through the hole, and the second wire rod 122 is fastened at and fixed to the hole FIG. 6A is a partial front cross-sectional view of an R-side of the headphones 10 and shows a configuration of the R-side folded portion 112, the first wire rod 121, and the second wire rod 122. FIG. 6B is a partially enlarged view when a circle portion indicated by a dashed line in FIG. 5A is enlarged. The R-side folded portion 112 has a configuration similar to that of the above-described L-side folded portion 111 and is provided on the R-side of the head band 20.

The first wire rod 121 has the one end side that is connected to the L-side slider 31 and the other end side that is connected to the R-side slider 32. The first wire rod 121 is provided to pass through the inside of the head band 20 and extends downward toward an R-side end of the head band 20. Then, the first wire rod 121 is inserted into the R-side folded portion 112 that is provided at the R-side end of the head band 20 and is folded upward. The folded first wire rod 121 extends upward and is connected to an upper end of the R-side slider 32. A method of connecting the first wire rod 121 and the R-side slider 32 includes a method in which a hole is provided at, for example, the R-side slider 32, the first wire rod 121 passes through the hole, and the first wire rod 121 is fastened at and fixed to the hole.

In this manner, the L-side folded portion 111 and the R-side folded portion 112, and the first wire rod 121 and the second wire rod 122 are provided inside the headphones 10 in a bilaterally symmetrical manner.

The first wire rod 121 and the second wire rod 122 are made of, for example, an aramid fiber, a metallic wire, or a carbon nanotube. When such a material having high rigidity is used, it is possible to downsize and increase durability of the headphones 10. However, the material of the first wire rod 121 and the second wire rod 122 is not limited thereto, and any material that is linear and has a strength by which it is not disconnected even when repeatedly pulled can be used.

In addition, the first wire rod 121 and the second wire rod 122 are covered by an outer tube made of an elastic material, for example, rubber. Therefore, it is possible to protect the wire rod. In addition, it is possible to reduce friction when the wire rod is pulled and moved.

Figure 7:
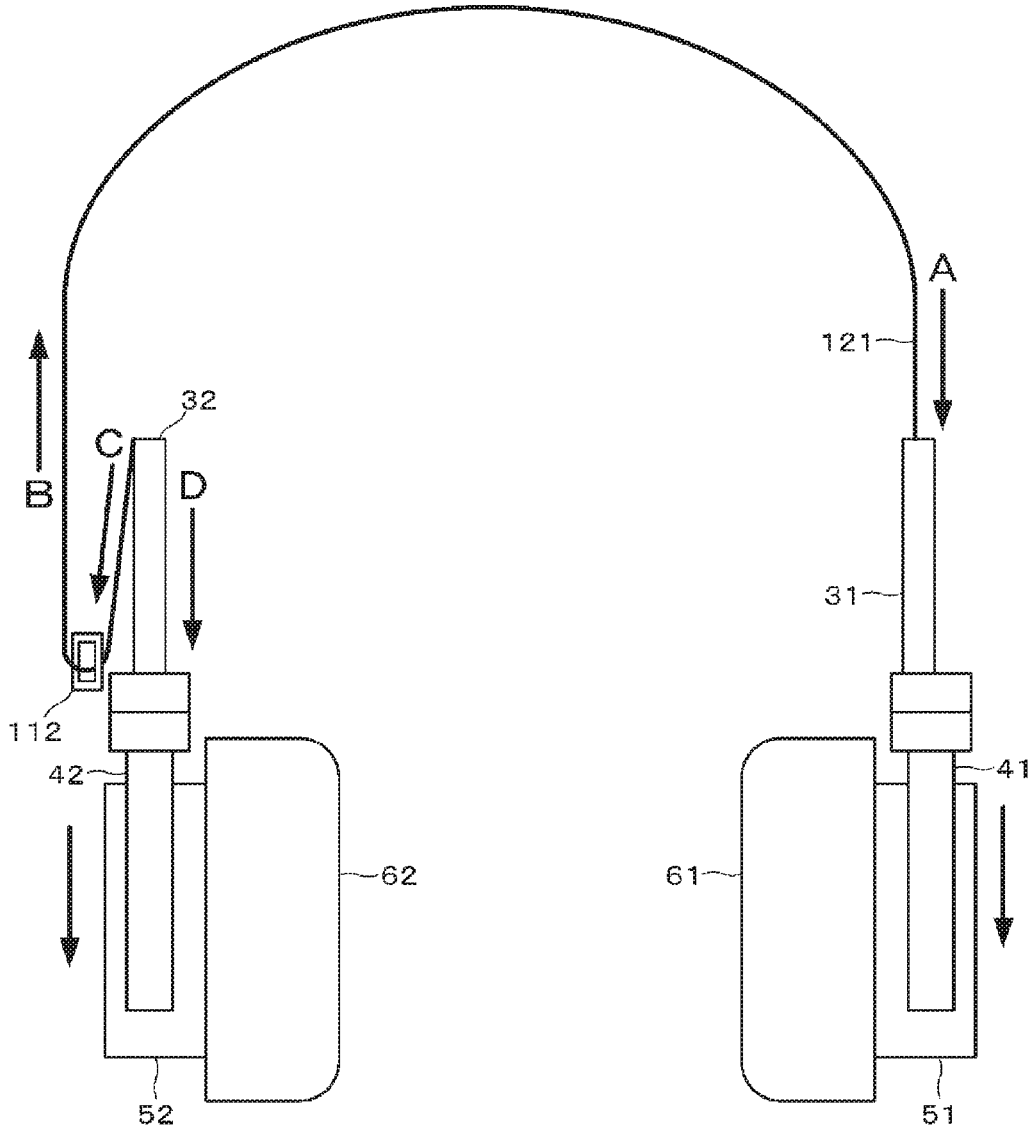
FIG. 7 is a diagram illustrating a drawing operation of a slider by a first wire rod.

Next, a sliding linkage by the first wire rod 121 will be described with reference to FIG. 7. First, an operation in which the slider is drawn in a direction will be described. While the first wire rod 121 and the second wire rod 122 are provided in the headphones 10 in the embodiment, only the first wire rod 121 will be exemplified in FIG. 7 for convenience of description. In addition, while the first wire rod 121 is provided along the head band 20, the head band 20 is omitted for convenience of description.

First, when the user slides the L-side slider 31 downward, the first wire rod 121 is pulled downward in the same direction as a slide direction of the L-side slider 31 by the L-side slider 31 at a position A. Thus, at a position B, the first wire rod 121 is pulled upward in linkage with the pulling at the position A.

Since the first wire rod 121 is folded at the R-side folded portion 112, next, at a position C, the first wire rod 121 is pulled downward opposite to the upward pulling at the position B. Thus, since the other end of the first wire rod 121 is connected to the R-side slider 32, the first wire rod 121 that is pulled downward at the position C pulls the R-side slider 32 downward as indicated by an arrow D.

Then, in linkage with the downward sliding of the L-side slider 31, the R-side slider 32 also slides downward in the same direction. Therefore, when the user slides the L-side slider 31 downward, the R-side slider 32 can automatically slide downward in linkage therewith.

Since all distances which the first wire rod 121 is pulled at the position A, the position B, the position C, and the position D are substantially the same, slide distances of the L-side slider 31 and the R-side slider 32 are also substantially the same. Accordingly, when the L-side slider 31 is slid, the R-side slider 32 can be slid only substantially the same distance as the slide distance.

Figure 8:
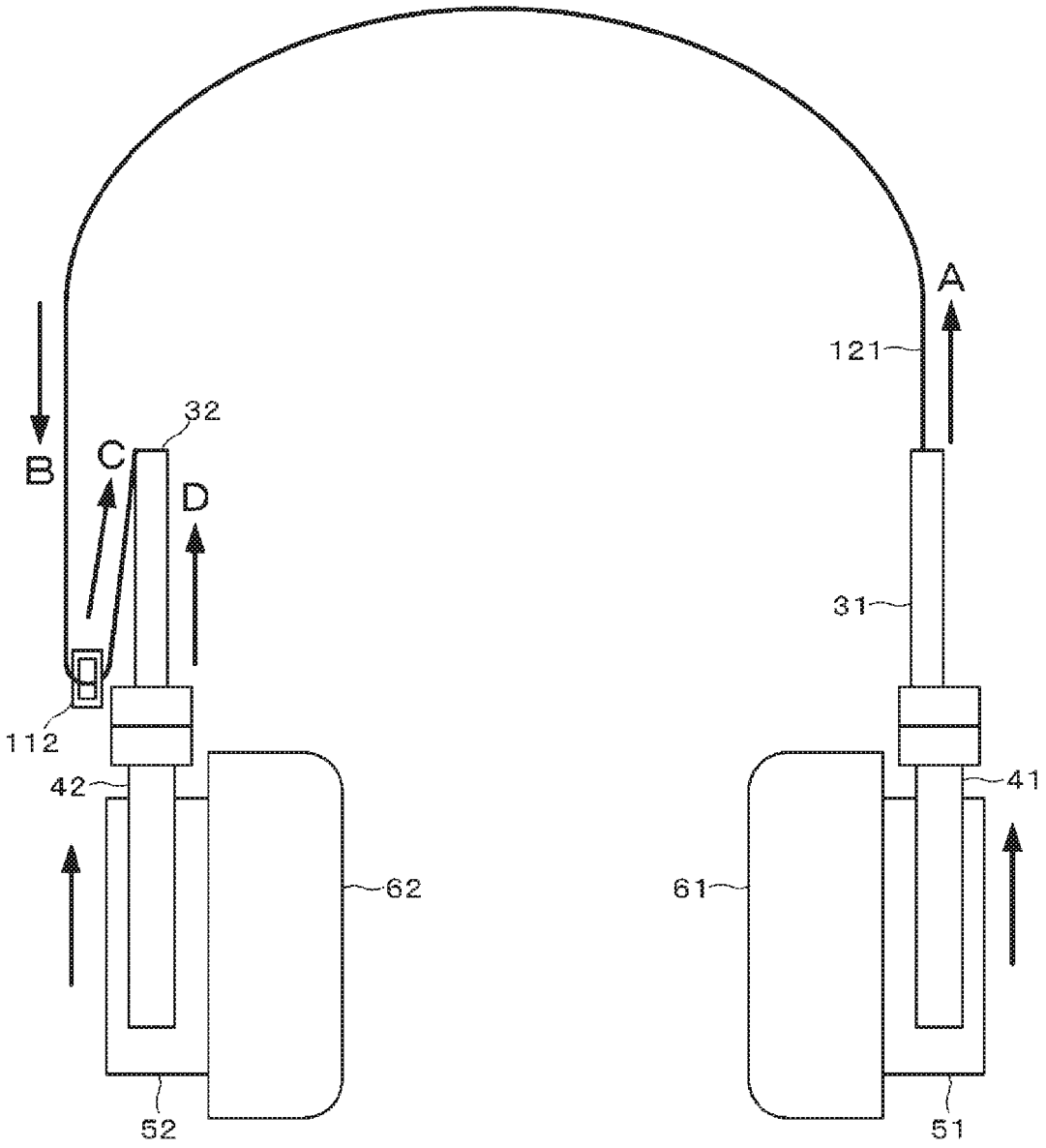
FIG. 8 is a diagram illustrating a housing operation of a slider by a first wire rod.

Next, an operation in which a slider is housed in a direction will be described with reference to FIG. 8. While the first wire rod 121 and the second wire rod 122 are provided in the headphones 10 in the embodiment, only the first wire rod 121 will be exemplified in FIG. 8 for convenience of description. In addition, while the first wire rod 121 is provided along the head band 20, the head band 20 is omitted for convenience of description.

When the R-side slider 32 is slid upward in a housing direction by the R-side slider 32 that slides upward at the position D, the first wire rod 121 is pulled upward in the same direction as a slide direction of the R-side slider 32 at the position C.

Since the first wire rod 121 is folded at the R-side folded portion 112, next, at the position B, the first wire rod 121 is pulled downward opposite to the upward pulling at the position C. Thus, since the other end of the first wire rod 121 is connected to the L-side slider 31, the first wire rod 121 pulls the L-side slider 31 upward at the position A.

Then, in linkage with the upward sliding of the R-side slider 32, the L-side slider 31 also slides upward in the same direction. Therefore, when the user slides the R-side slider 32 upward, the L-side slider 31 can automatically slide upward in linkage therewith.

All distances which the first wire rod 121 is pulled are substantially the same at the position A, the position B, the position C, and the position D, slide distances of the L-side slider 31 and the R-side slider 32 are also substantially the same. Accordingly, when the L-side slider 31 is slid, the R-side slider 32 can be slid only substantially the same distance as the slide distance.

Figure 9:
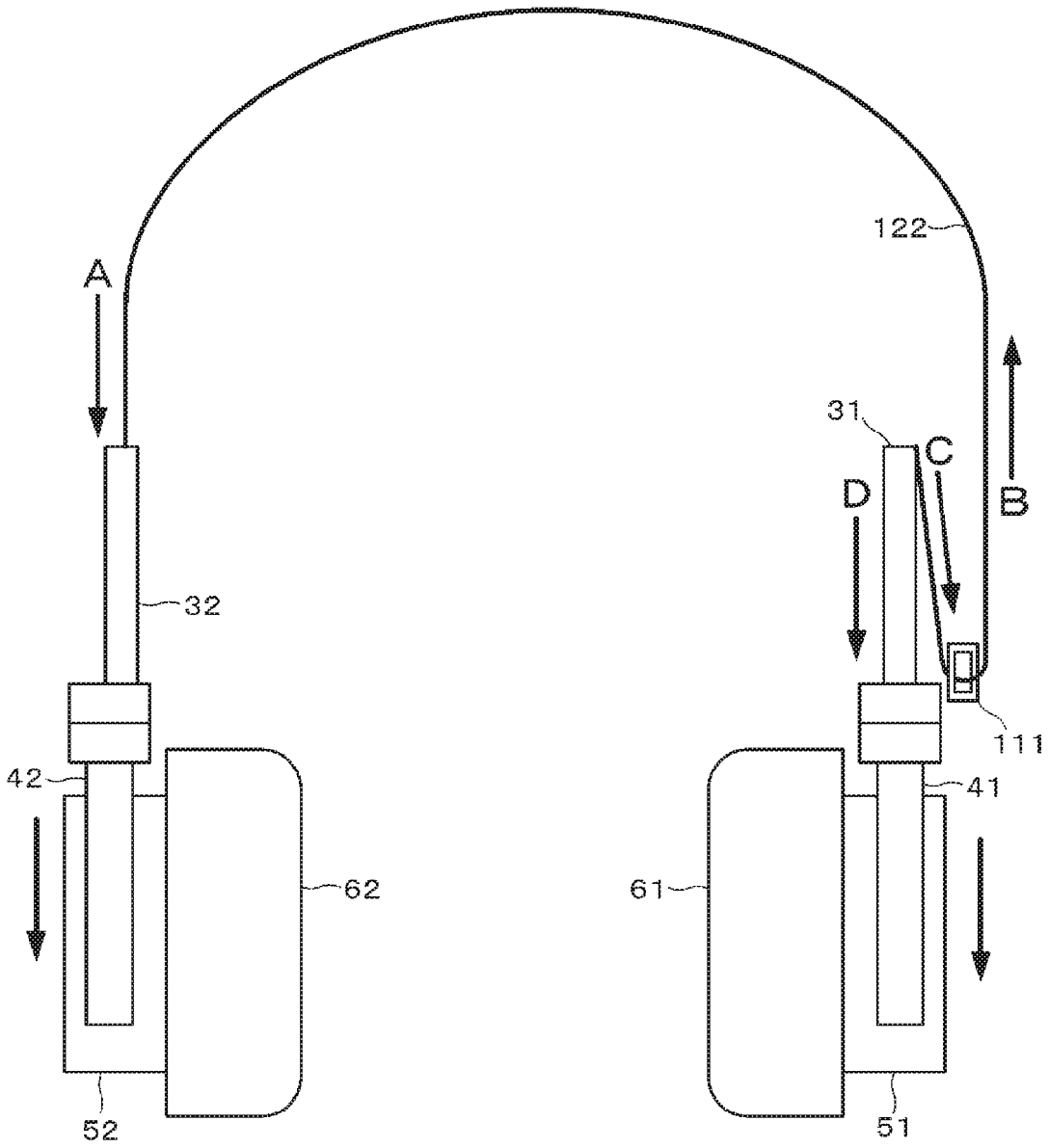
FIG. 9 is a diagram illustrating a drawing operation of a slider by a second wire rod.

Next, a slide operation of the second wire rod 122 will be described with reference to FIG. 9. For convenience of description, only the second wire rod 122 will be exemplified in FIG. 9. In addition, while the second wire rod 122 is provided inside the head band 20, the head band 20 is omitted for convenience of description.

First, an operation in which a slider is drawn in a direction will be described. First, when the user slides the R-side slider 32 downward, the second wire rod 122 is pulled downward in the same direction as a slide direction of the R-side slider 32 by the R-side slider 32 at the position A. Thus, at the position B, the second wire rod 122 is pulled upward in linkage with pulling at the position A.

Since the second wire rod 122 is folded at the L-side folded portion 111, next, at the position C, the second wire rod 122 is pulled downward opposite to the upward pulling at the position B. Thus, since the other end of the second wire rod 122 is connected to the L-side slider 31, the second wire rod 122 that is pulled downward at the position C pulls the L-side slider 31 downward.

Then, in linkage with the downward sliding of the R-side slider 32, the L-side slider 31 also slides downward in the same direction. Therefore, when the user slides the R-side slider 32 downward, the L-side slider 31 can automatically slide downward in linkage therewith.

Since all distances which the first wire rod 122 is pulled at the position A, the position B, the position C, and the position D are substantially the same, slide distances of the R-side slider 32 and the L-side slider 31 are also substantially the same. Accordingly, when the R-side slider 32 is slid, the L-side slider 31 can be slid only substantially the same distance as the slide distance.

Figure 10:
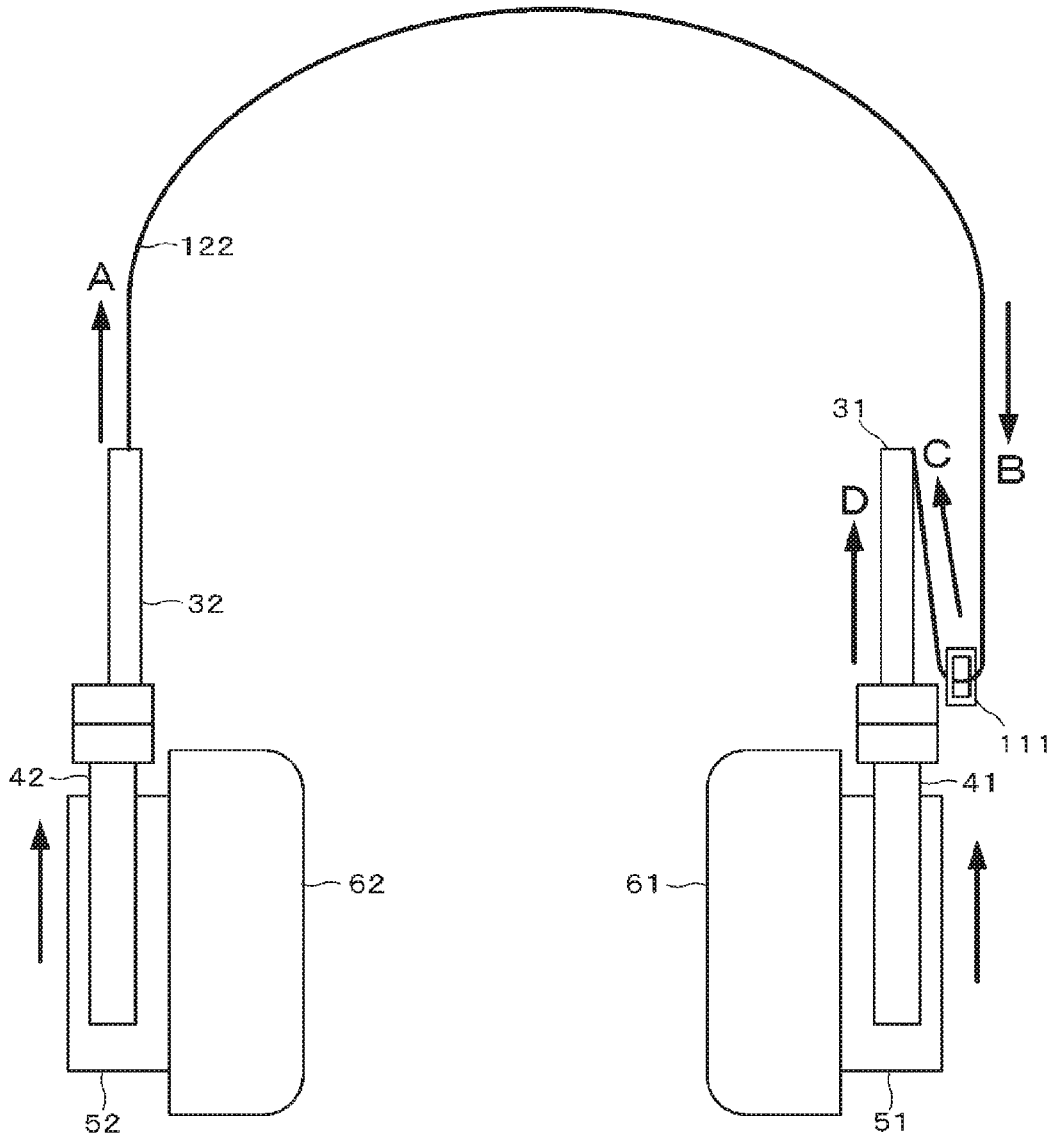
FIG. 10 is a diagram illustrating a housing operation of a slider by a second wire rod.

Next, an operation in which a slider is housed in a direction by the second wire rod 122 will be described with reference to FIG. 10. For convenience of description, only the second wire rod 122 will be exemplified in FIG. 10. In addition, while the second wire rod 122 is provided inside the head band 20, the head band 20 is omitted for convenience of description.

When the L-side slider 31 is slid upward in the housing direction by the L-side slider 31 that slides upward at the position D, the second wire rod 122 is pulled upward in the same direction as a slide direction of the L-side slider 31 at the position C.

Since the second wire rod 122 is folded at the L-side folded portion 111, next, at the position B, the second wire rod 122 is pulled downward opposite to the upward pulling at the position C. Thus, since the other end of the second wire rod 122 is connected to the R-side slider 32, the second wire rod 122 pulls the R-side slider 32 upward at the position A.

Then, in linkage with the upward sliding of the L-side slider 31, the R-side slider 32 also slides upward in the same direction. Therefore, when the user slides the L-side slider 31 upward, the R-side slider 32 can automatically slide upward in linkage therewith.

All distances which the second wire rod 122 is pulled are substantially the same at the position A, the position B, the position C, and the position D, slide distances of the R-side slider 32 and the L-side slider 31 are also substantially the same. Accordingly, when the R-side slider 32 is slid, the L-side slider 31 can be slid only substantially the same distance as the slide distance.

Accordingly, when the L-side slider 31 is slid, the R-side slider 32 slides the same slide distance in the same direction in linkage therewith. Further, when the R-side slider 32 is slid, the L-side slider 31 slides the same slide distance in the same direction in linkage therewith. Therefore, it is not necessary to separately slide the L-side slider 31 and the R-side slider 32. In addition, it is possible to remove a burden of separately sliding sliders while visually confirming whether slide distances of the left and right sliders are the same. Accordingly, there is no lateral difference in slide distances of sliders and it is possible to quickly wear the headphones 10. In addition, an operation feeling is unlikely to change since mechanical operations in a drawing direction and the housing direction on the L-side and the R-side are mirror-symmetric.

When the user wears the headphones 10, first, be or she puts the head band 20 on his or her head. Next, be or she grips the L-side housing 51 with his or her left hand and grips the R-side housing 52 with his or her right hand, and be or she simultaneously slides the L-side housing 51 and the R-side housing 52 downward in the drawing direction to move them to positions that be or she desires.

Then, by the linkage slide mechanism including the first folded portion 111, the second folded portion 112, the first wire rod 121, and the second wire rod 122 described above, both the L-side slider 31 and the R-side slider 32 slide substantially the same distance and both the left and right sliders are uniformly drawn.

A method of wearing the headphones 10 is not limited to the above method. Before the head band 20 abuts the head, when the L-side slider 31 and the R-side slider 32 are slid, they are uniformly drawn. Then, the headphones 10 may be worn on the head.

2. Modified Examples

While an embodiment of the present technology has been specifically described above, the present technology is not limited to the above-described embodiment, and various modifications based on the scope of the present technology can be provided.

Figure 11:
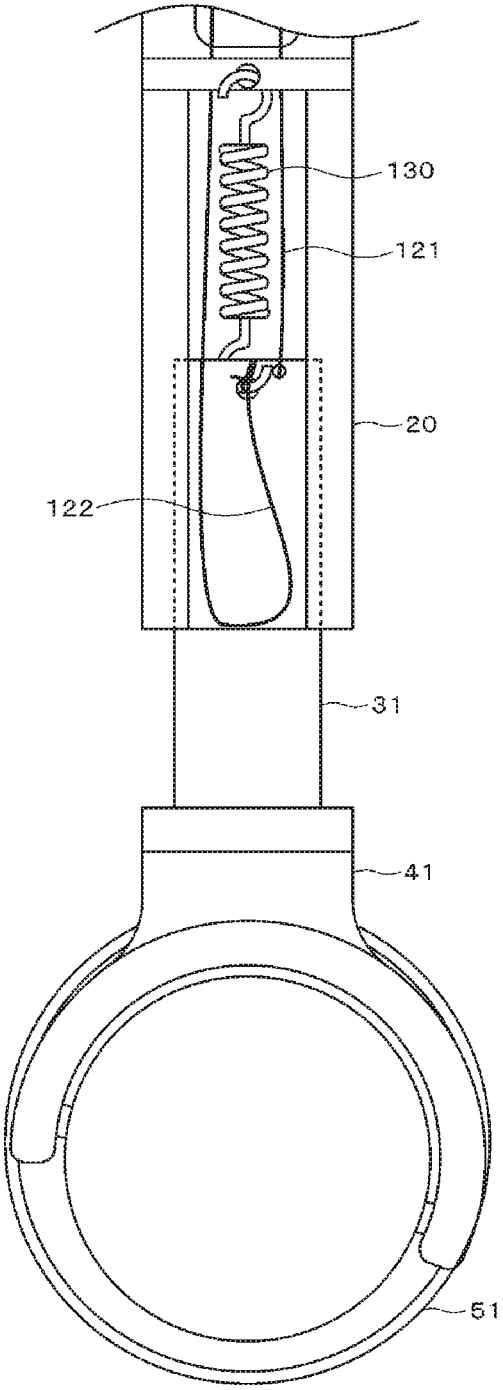
FIG. 11 is a side view illustrating a first modified example of the headphones according to the present technology.

First, a first modified example will be described with reference to FIG. 11. FIG. 11 is a side view illustrating an L-side internal configuration of the head band 20. In FIG. 11, the inside of the head band 20 when the cover of the head band 20 is removed is illustrated. In FIG. 11, while the L-side folded portion 111 is not illustrated, the first wire rod 121 is folded at the L-side folded portion 111.

In the first modified example, an elastic body 130 is provided to connect the head band 20 and the L-side slider 31. As the elastic body 130, for example, a coil spring or rubber is exemplified. The elastic body 130 is always biased upward in a housing direction of the L-side slider 31.

When the L-side slider 31 is slid downward in a drawing direction and the headphones 10 are worn, a position of the L-side slider 31 is fixed due to friction between the L-side slider 31 and the head band 20 and friction and interlocking between the user's ear and the L-side ear pad 61. Therefore, when the headphones 10 are worn, the L-side slider 31 does not slide in the housing direction and positions of the L-side housing 51 and the L-side ear pad 61 do not change.

Then, when use of the headphones 10 ends and the headphones 10 are removed from the head, the L-side slider 31 pulled by the elastic body 130 slides upward in the housing direction. FIG. 11 is a side view illustrating a configuration of the L-side, and the R-side has the same configuration. However, the elastic body 130 may be provided to only any one of the L-side and the R-side. In this manner, since the L-side slider 31 and the R-side slider 32 can automatically slide for housing, it is possible to remove a burden of sliding the slider for housing.

Figure 12:
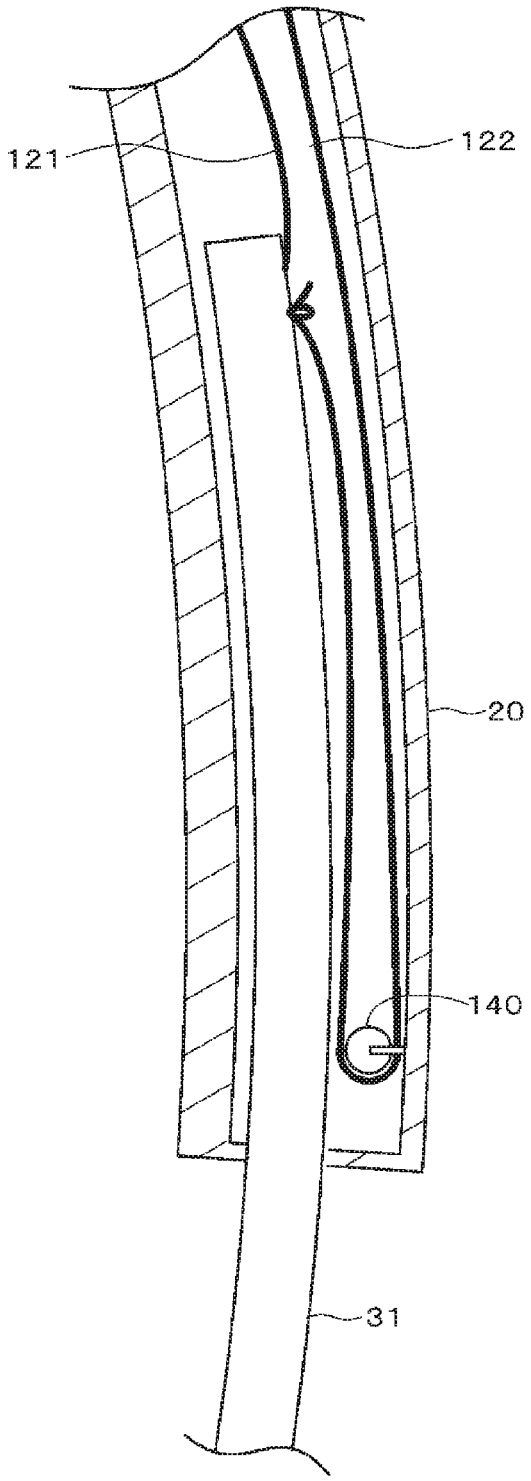
FIG. 12 is a front cross-sectional view illustrating a second modified example of the headphones according to the present technology.

Next, a second modified example will be described with reference to FIG. 12. FIG. 12 is a front cross-sectional enlarged view illustrating a configuration of the L-side slider 31 and the head band 20. In the above-described embodiment, the L-side folded portion 111 and the R-side folded portion 112 have a configuration that slides while a wire rod passes through an internal hole, but the configuration of the folded portion is not limited thereto. As illustrated in FIG. 12, the first folded portion may be configured by a pulley 140.

If the first folded portion is configured by the pulley 140, the pulley 140 rotates when the second wire rod 122 is pulled according to sliding of the L-side slider 31, and the second wire rod 122 is pulled more smoothly. Therefore, the first slider 31 also slides more smoothly. Further, it is possible to prevent damage due to wear of the first folded portion and the second folded portion. Although not illustrated, in the second modified example, the second folded portion may also be configured by a pulley.

Next, a third modified example will be described. In the above-described embodiment, a wire rod is dedicated to linked sliding using an aramid fiber, a metallic wire, or a carbon nanotube. However, the wire rod is not limited to a wire rod using such a material, and a conducting wire for a sound signal may be used as the wire rod.

Figure 13:
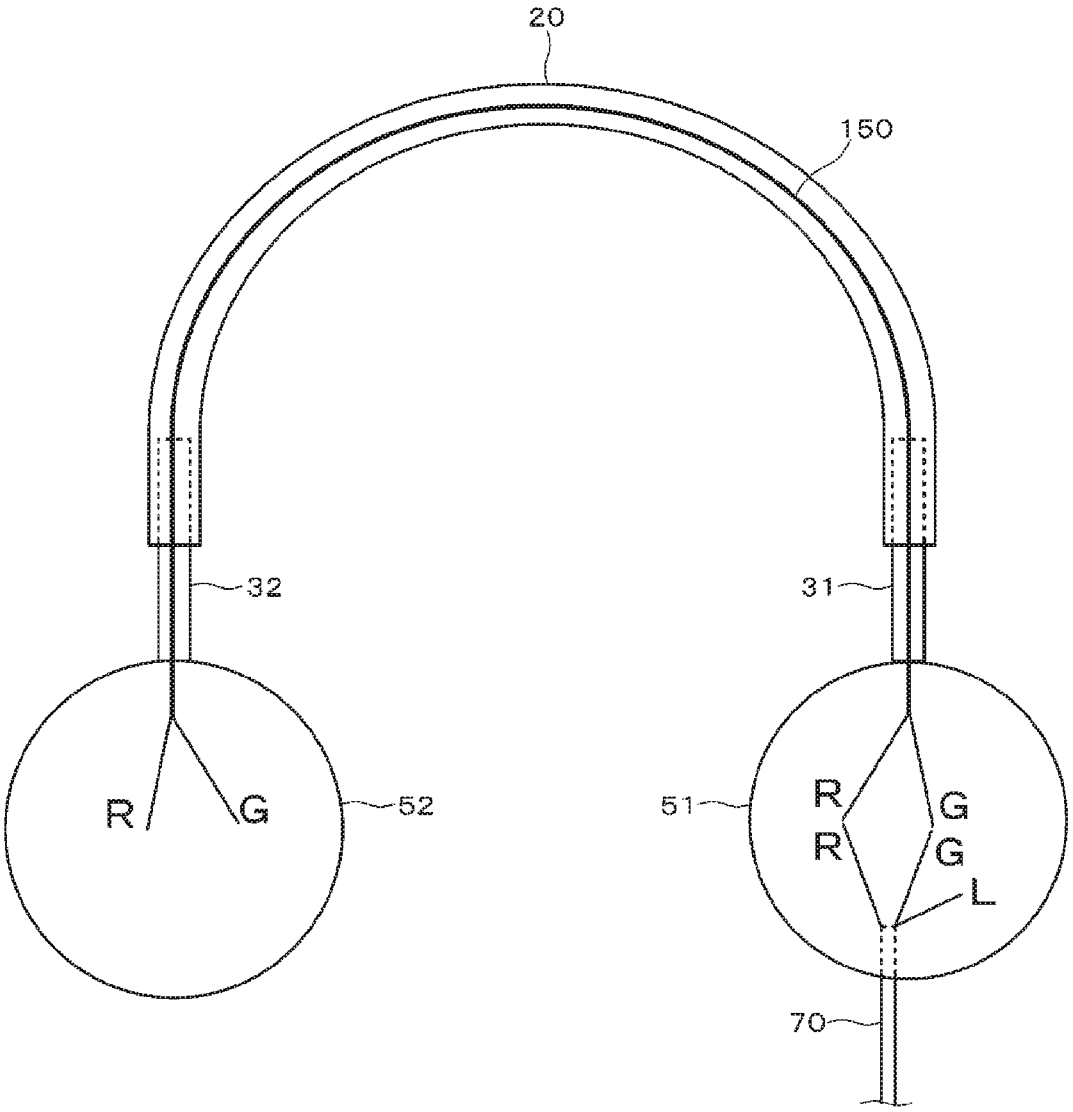
FIG. 13 is a diagram illustrating a configuration of a sound signal transmission line in a third modified example of the headphones according to the present technology.
Figure 14:
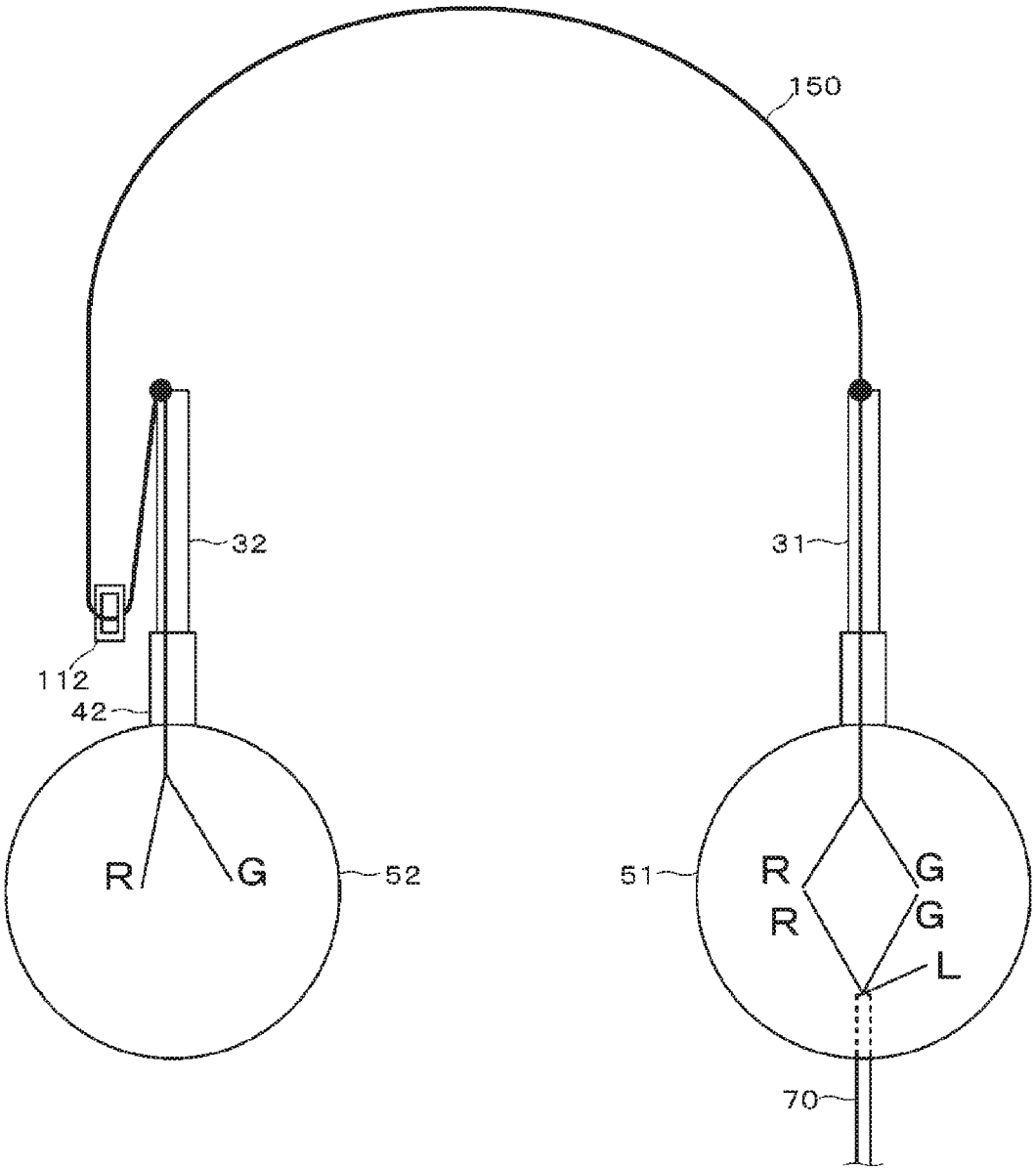
FIG. 14 is a diagram illustrating a configuration of the sound signal transmission line in the third modified example of the headphones according to the present technology.

FIG. 13 is a simplified diagram of the headphones 10 and shows a configuration of a conducting wire for a sound signal in the headphones 10. In FIG. 13, for convenience of description, the L-side hanger 41 and the R-side hanger 42 are omitted to simplify illustration. FIG. 14 is a simplified diagram of the headphones 10 when the conducting wire for a sound signal is used as the wire rod. In FIG. 14, for convenience of description, the head band 20, the L-side hanger 41, and the R-side hanger 42 are omitted to simplify illustration. For example, in the headphones 10, as illustrated in FIG. 13, when the cord 70 is connected to the L-side housing 51 that is one housing, the conducting wire for a sound signal is derived to the R-side housing 52 that is the other housing through the inside of the head band 20 as a bridge cord 150. In this case, the L channel conducting wire, the R channel conducting wire, and the ground line are included in the cord 70. In the L-side housing 51 to which the cord 70 is connected, the L channel conducting wire and the ground line are connected to the sound processing circuit and the driver unit inside the housing.

Then, the R channel conducting wire and the ground line extend to the R-side housing 52 through the inside of the head band 20 as the bridge cord 150, and are connected to the sound processing circuit and the driver unit inside the R-side housing 52.

In this case, the R channel conducting wire that passes through the inside of the head band 20 and the bridge cord 150 serving as the ground line are covered by an outer tube and handled as a single wire rod. Then, as illustrated in FIG. 14, the L-side slider 31 and the R-side slider 32 are connected using the bridge cord 150 as the wire rod through the R-side folded portion 112. Then, the bridge cord 150 is the conducting wire for a sound signal, extends from the R-side slider 32 to an inside of the R-side housing 52, and is connected to the sound processing circuit and the driver unit inside the R-side housing 52. A linkage slide operation in this case is similar to that in the embodiment. In this manner, it is possible to simplify a component using the conducting wire for a sound signal as the wire rod. A configuration different from that of FIG. 14, in which the cord 70 is connected to the R-side housing and the folded portion is provided on the L-side, may be provided.

Figure 15:
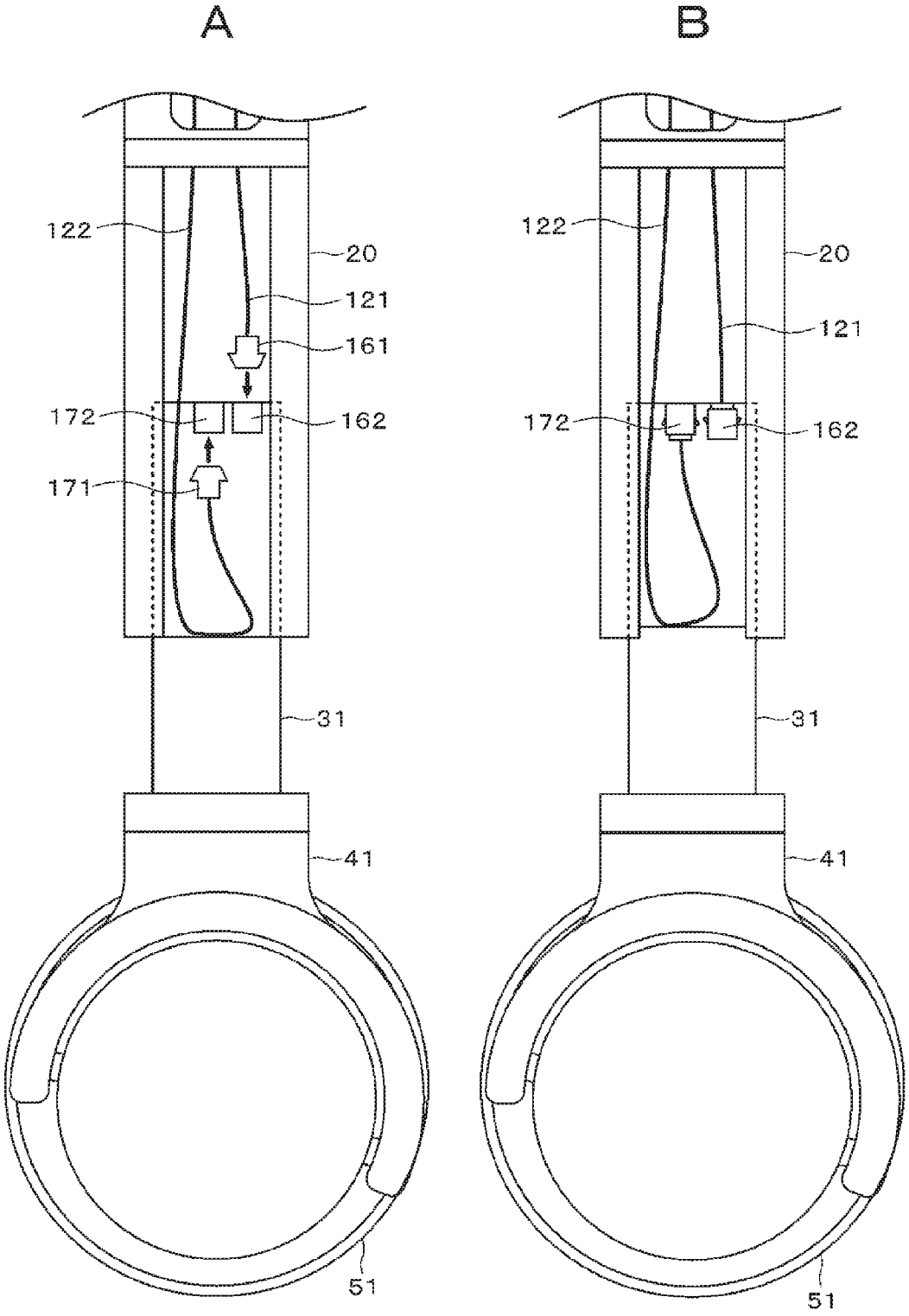
FIG. 15A is a side view illustrating a configuration of a fourth modified example of the headphones according to the present technology.
FIG. 15B is a side view illustrating a state in which a connector of the headphones according to the fourth modified example is connected.

Next, a fourth modified example will be described with reference to FIG. 15. The fourth modified example relates to connection between a wire rod and a slider. FIG. 15 illustrates a configuration of the L-side of the headphones and is an internal configuration diagram of the head band 20 when the cover of the head band 20 is removed. In the drawing, while the L-side folded portion 111 is not illustrated, the first wire rod 121 is folded at the L-side folded portion 111.

In the present modified example, a first connector 161 is provided on one end side of the first wire rod 121. A first connector receiving portion 162 is provided at the upper end of the L-side slider 31. In addition, a second connector 171 is provided at one end of the second wire rod 122 that extends from the R-side slider 32 to the L-side slider 31. A second connector receiving portion 172 is provided at the upper end of the L-side slider 32.

Figure 16:
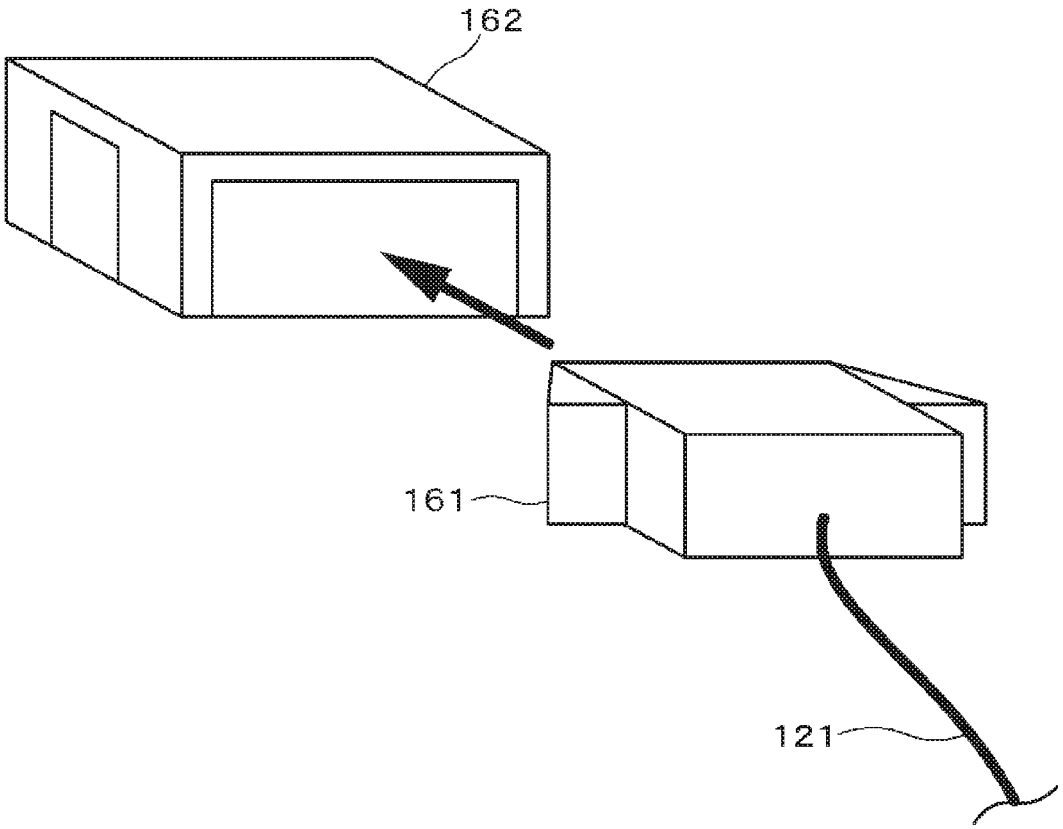
FIG. 16 is a diagram illustrating an exemplary shape of the connector in the fourth modified example.

As illustrated in FIG. 16, the first connector 161 includes, for example, a claw portion, and the first connector receiving portion 162 includes a hole into which the connector is inserted and an engaging hole with which the claw portion of the connector is engaged. The second connector 171 and the second connector receiving portion 172 are also similarly configured.

As illustrated in FIG. 15A, when the first connector 161, to which the first wire rod 121 is connected, is inserted into the first connector receiving portion 162 as illustrated in FIG. 15B, the claw portion is inserted into the engaging hole, and thus the first connector 161 and the first connector receiving portion 162 are connected. Therefore, the first wire rod 121 and the L-side slider 31 are connected.

In addition, the second connector 171 is provided at one end of the second wire rod 122, and the second connector receiving portion 172 is provided at the upper end of the L-side slider 32. The second connector 171 and the second connector receiving portion 172 are connected similarly to the connection of the first connector 161 and the first connector receiving portion 162. Therefore, the second wire rod 122 and the L-side slider 32 are connected. The R-side slider 32, the first wire rod 121, and the second wire rod 122 are similarly connected using a connector In this manner, when the connector is used to connect the wire rod and the slider, since it is possible to reduce time and effort for attaching the wire rod to the connector, it is possible to simplify a manufacturing process.

The structure of the connector is not limited to those illustrated in FIG. 15 and FIG. 16, and any connector configuration that can be connected at the connector receiving portion for fixation may be used.

The headphones 10 including two wire rods such as the first wire rod 121 and the second wire rod 122 have been described in the embodiment. However, the number of wire rods is not limited to two, and may be one. When the number of wire rods is one, one folded portion may be provided.

When a wire rod to be used has insufficient rigidity between the L-side and the R-side, a slider on a side in which no folded portion is provided is set as a slider for drawing that slides during drawing. On the other hand, a slider on a side in which the folded portion is provided is set as a slider for housing that slides during housing. As described with reference to FIG. 7 to FIG. 10, this is because one slider functions as a slider for drawing and the other slider functions as a slider for housing in one wire rod. In this case, a slider for drawing or a slider for housing in the housing and the head hand may be indicated by a letter or a mark. On the other hand, when the wire rod to be used has sufficient rigidity to the extent that the wire rod is not loosened inside, any of the L-side and the R-side may be used for drawing and accommodation.

Additionally, the present technology may also be configured as below.

(1)

Headphones including:

a head band;

a first slider that is provided on one end side of the head band and slides with respect to the head band;

a second slider that is provided on the other end side of the head band and slides with respect to the head band;

a connecting portion that connects the first slider and the second slider and slides the second slider in linkage with a slide operation of the first slider; and a pair of housings that are provided on the first slide portion and the second slide portion, respectively, and each house a sound output unit.

(2)

The headphones according to (1), wherein a folded portion is provided at the head band, and the second slider is slid in the same direction as a slide direction of the first slider by the connecting portion being folded at the folded portion.

(3)

The headphones according to (1) or (2), wherein the connecting portion slides the second slider substantially the same distance as a slide distance of the first slider by the slide operation of the first slider.

(4)

The headphones according to any one of (1) to (3), wherein the folded portion is provided at one side and the other side of the head band, and the connecting portion includes a first connecting portion and a second connecting portion, the first connecting portion slides the second slide portion in linkage with sliding of the first slide portion and the second connecting portion slides the first slide portion in linkage with sliding of the second slide portion.

(5)

The headphones according to any one of (1) to (4), wherein the connecting portion is configured by a wire rod.

(6)

The headphones according to (5), wherein the connecting portion is made of an aramid fiber, a metallic wire, or a carbon nanotube.

(7)

The headphones according to any one of (1) to (6), wherein the connecting portion is covered by an outer tube.

(8)

The headphones according to (2), wherein the folded portion is configured by a pulley.

(9)

The headphones according to any one of (1) to (8), wherein the connecting portion is configured by a sound signal transmission line.

(10)

The headphones according to (9), wherein the sound signal transmission line is electrically coupled to a signal line through which a sound signal from a sound reproducing device is transmitted.

(11)

The headphones according to any one of (1) to (10), wherein the connecting portion, and the first slider and the second slider are connected by a connector.

(12)

The headphones according to any one of (1) to (11), wherein the first slider and the second slider have positions that are maintained by friction with the head band.

(13)

The headphones according to (2), wherein the folded portion is provided only at one side of the head band, and a notation is provided to indicate a side at which the folded portion of the head band is provided and a side at which the folded portion of the head band is not provided.

REFERENCE SIGNS LIST

10 headphones
20 head band
31 L-side slider
32 R-side slider
51 L-side housing
52 R-side housing
111 first folded portion
112 second folded portion
121 first wire rod
122 second wire rod
130 elastic body
140 pulley
150 bridge cord
161 first connector
162 first connector receiving portion
171 second connector
172 second connector receiving portion

What is claimed is:

1. Headphones comprising:

a head band;

a first slider that is provided on one end side of the head band and slides with respect to the head band;

a second slider that is provided on the other end side of the head band and slides with respect to the head band;

a connecting portion that connects the first slider and the second slider and slides the second slider in linkage with a slide operation of the first slider; and a pair of housings that are connected to the first slider and the second slider, respectively, and that each house a sound output unit, wherein a folded portion is provided at the head band, and the second slider is slid in the same direction as a slide direction of the first slider by the connecting portion being folded at the folded portion.

2. The headphones according to claim 1, wherein the connecting portion slides the second slider substantially the same distance as a slide distance of the first slider by the slide operation of the first slider.

3. Headphones comprising:

a head band;

a first slider that is provided on one end side of the head band and slides with respect to the head band;

a second slider that is provided on the other end side of the head band and slides with respect to the head band;

a connecting portion that connects the first slider and the second slider and slides the second slider in linkage with a slide operation of the first slider; and a pair of housings that are connected to the first slider and the second slider, respectively, and that each house a sound output unit, wherein a folded portion is provided at one side and the other side of the head band, wherein the connecting portion includes a first connecting portion and a second connecting portion, and wherein the first connecting portion slides the second slider in linkage with sliding of the first slider and the second connecting portion slides the first slider in linkage with sliding of the second slider.

4. The headphones according to claim 1, wherein the connecting portion includes a wire rod.

5. Headphones comprising:

a head band;

a first slider that is provided on one end side of the head band and slides with respect to the head band;

a second slider that is provided on the other end side of the head band and slides with respect to the head band;

a connecting portion that connects the first slider and the second slider and slides the second slider in linkage with a slide operation of the first slider; and a pair of housings that are connected to the first slider and the second slider, respectively, and that each house a sound output unit, wherein the connecting portion is made of an aramid fiber, a metallic wire, or a carbon nanotube.

6. The headphones according to claim 1, wherein the connecting portion is covered by an outer tube.

7. The headphones according to claim 1, wherein the folded portion is configured by a pulley.

8. The headphones according to claim 1, wherein the connecting portion is configured by a sound signal transmission line.

9. Headphones comprising:

a head band;

a first slider that is provided on one end side of the head band and slides with respect to the head band;

a second slider that is provided on the other end side of the head band and slides with respect to the head band;

a connecting portion that connects the first slider and the second slider and slides the second slider in linkage with a slide operation of the first slider; and a pair of housings that are connected to the first slider and the second slider, respectively, and that each house a sound output unit, wherein the connecting portion includes a sound signal transmission line, and wherein the sound signal transmission line is electrically coupled to a signal line through which a sound signal from a sound reproducing device is transmitted.

10. The headphones according to claim 1, wherein the connecting portion, and the first slider and the second slider are connected by a connector.

11. The headphones according to claim 1, wherein the first slider and the second slider have positions that are maintained by friction with the head band.

12. The headphones according to claim 1, wherein the folded portion is provided only at one side of the head band, and a notation is provided to indicate a side at which the folded portion of the head band is provided and a side at which the folded portion of the head band is not provided.

13. The headphones according to claim 3, wherein the connecting portion slides the second slider substantially the same distance as a slide distance of the first slider by the slide operation of the first slider.

14. The headphones according to claim 3, wherein the connecting portion includes a wire rod.

15. The headphones according to claim 3, wherein the connecting portion is covered by an outer tube.

16. The headphones according to claim 3, wherein the folded portion is configured by a pulley.

17. The headphones according to claim 3, wherein the connecting portion is configured by a sound signal transmission line.

18. The headphones according to claim 3, wherein the connecting portion, and the first slider and the second slider are connected by a connector.

19. The headphones according to claim 3, wherein the first slider and the second slider have positions that are maintained by friction with the head band.

20. The headphones according to claim 5, wherein the connecting portion slides the second slider substantially the same distance as a slide distance of the first slider by the slide operation of the first slider.

* * * * *